United States Patent [19]

Kamelander

[11] 3,995,470

[45] Dec. 7, 1976

[54] METAL-FORMING SYSTEMS

[75] Inventor: Ivan Kamelander, Brno, Czechoslovakia

[73] Assignee: Vyzkumny ustav tvarecich střeju a technologie tvareni, Brno, Czechoslovakia

[22] Filed: Apr. 29, 1975

[21] Appl. No.: 572,940

[52] U.S. Cl. ..... 72/405; 72/421; 29/568

[51] Int. Cl.[2] ..... B21J 9/18

[58] Field of Search ..... 72/405, 404, 419, 421, 72/424, 427, 350, 446, 448; 29/568

[56] References Cited

UNITED STATES PATENTS

| | | | |
|---|---|---|---|
| 2,925,847 | 2/1960 | Burns | 72/405 |
| 3,727,442 | 4/1973 | Ridgway | 29/568 |
| 3,805,582 | 4/1974 | Logan | 72/420 |
| 3,880,020 | 4/1975 | Clem | 29/568 |

*Primary Examiner*—C.W. Lanham
*Assistant Examiner*—Gene P. Crosby

[57] ABSTRACT

A central metal-forming press has permanently associated therewith at least three workpiece-handling units that are pivotally connected to the press for movement toward and away from an operative position with respect to the press. A progressively interengaged system of links coupled to the main drive shaft of the press is clutch-coupled to each of the auxiliary handling units for separately engaging such units to effect workpiece introduction into, workpiece discharge from, and workpiece transfer within the press.

8 Claims, 4 Drawing Figures

METAL-FORMING SYSTEMS

BACKGROUND OF THE INVENTION

Presently known program-operated material-forming presses are typically associated with auxiliary workpiece introduction, discharge and transfer apparatus for establishing the flow of material with respect to the press proper. Such systems also have interchangeable tool holders for operating on the workpiece in accordance with the set program.

One disadvantage of known metal-forming systems of this type is their lack of versatility in the types of material transfer operations that are capable of being performed by means of the auxiliary handling apparatus, and because of the inflexibility in the individual drive systems for the individual workpiece and tool-positioning portions of the system.

SUMMARY OF THE INVENTION

Such disadvantage is overcome with the improved, highly versatile metal-forming system provided by the present invention. In an illustrative embodiment, the system includes a central press operating from a main drive shaft for performing operations on a workpiece, and at least first, second and third auxiliary workpiece-handling elements that are pivotably movable into an operating position adjacent the press.

The auxiliary handling elements are selectably clutch-coupled to spaced portions of an interengaged link system which is driven off the main shaft of the press. In particular, a first one of the auxiliary handling elements is driven off a first link portion of the link system, and a second one of the auxiliary handling elements is driven off the first link portion. In like manner, the third one of the auxiliary handling elements is driven off the second link portion, so that a progressive drive results.

The tool holder of the press is provided with a movable tool-positioner which is selectively clutch-engaged with a fourth link portion of the drive link system, such fourth link portion being driven off the second link portion in parallel with the third link portion.

If desired, a workpiece magazine may be pivotally connected to the press for vertical movement into a position adjacent one of the auxiliary workpiece-handling elements.

BRIEF DESCRIPTION OF THE DRAWING

The invention is further set forth in the following detailed description taken in conjunction with the appended drawing, in which.

DETAILED DESCRIPTION

Figure 1:
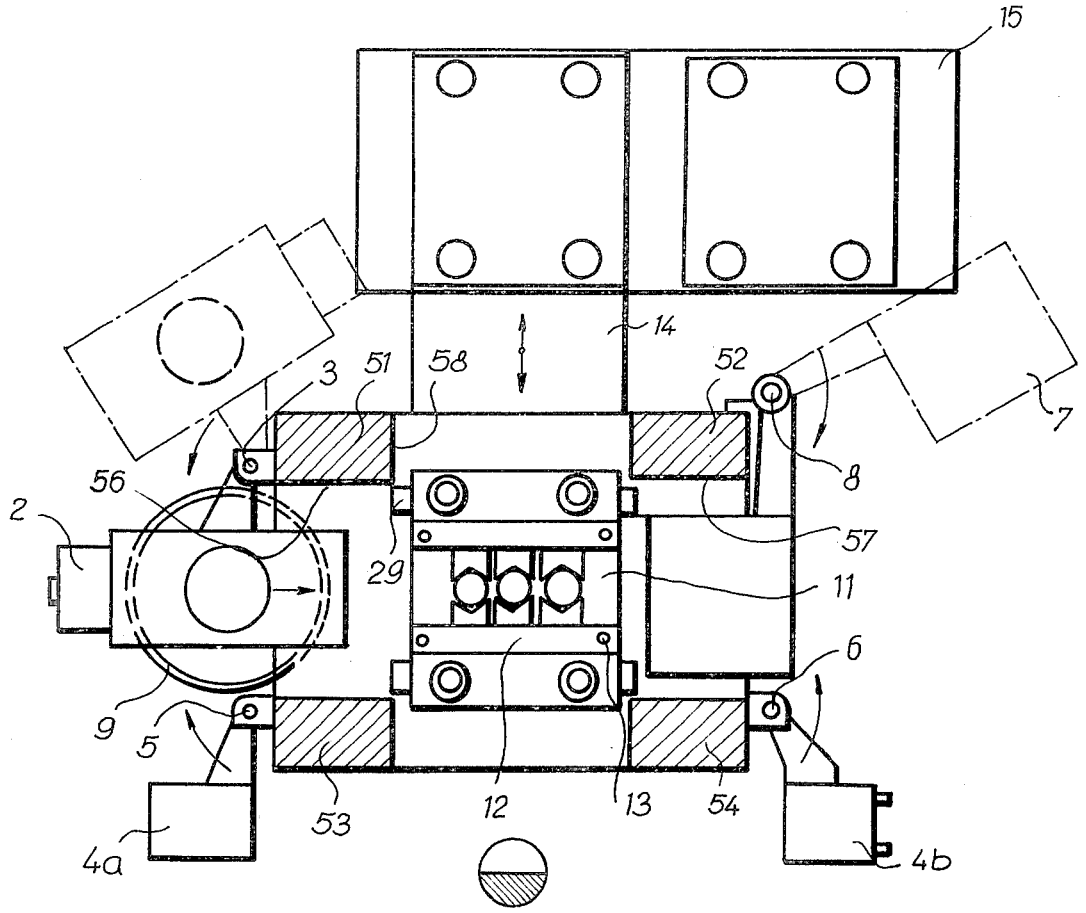
FIG. 1 is a plan view, partially in section, of a metal-forming system constructed in accordance with the invention.

Referring now to the drawing, an illustrative metal-forming system constructed in accordance with the invention includes a mechanical press having a column-type frame 1. The frame includes individual column members 51, 52, 53 and 54 which are disposed in spaced relation to define a rectangular space which is dividable into a workpiece-introduction area 56, a workpiece-discharge area 57, and a working tool access area 58. A plurality of vertical shafts 3, 5, 6 and 8 are respectively affixed to columns 51–54.

A pair of auxiliary workpiece-introduction devices 2 and **4*a* are pivotally coupled via shafts 3 and 5, to the columns 51 and 53 for selective movement in a horizontal plane toward and away from the workpiece-introduction area 56 of the machine. In like manner, a conventional workpiece transfer drive unit 7 and a discharge unit 4b are coupled via shafts 8 and 6, respectively, to the columns 52 and 54 for separate movement in a horizontal plane to and from an operating position in the discharge space 57. Each of such auxiliary handling units is individually operable, illustratively in accordance with a program, in a predetermined movement with respect to the press by means of a clutch connection to a link-type drive system 61** (FIG. 4), described in more detail below.

Figure 2:
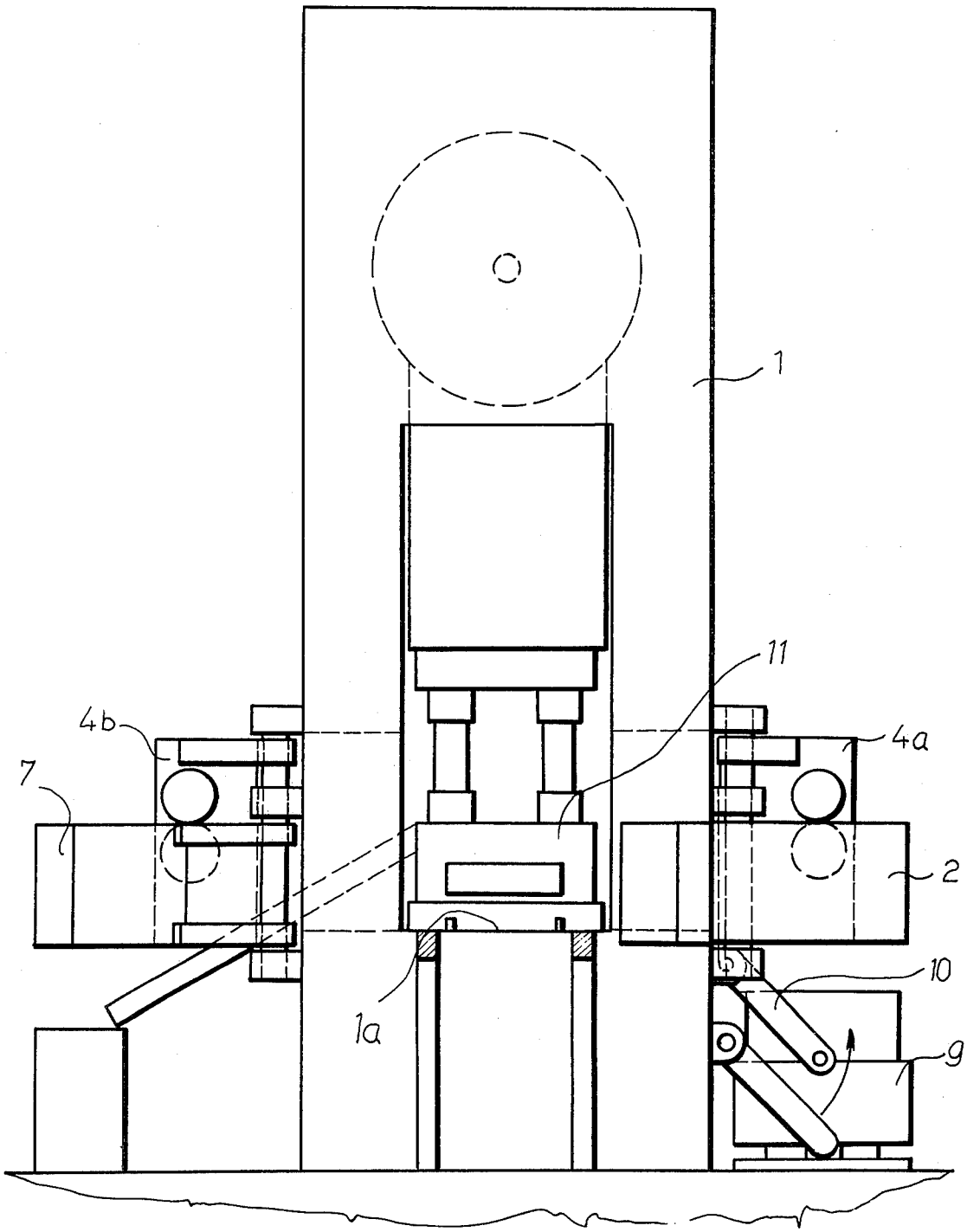
FIG. 2 is an elevation view of the system of FIG. 1, with auxiliary workpiece-handling means thereof being shown in their operative position.

As shown best in FIG. 2, a magazine 9 is pivotally connected via links 10 for movement in a vertical plane from a lower position shown to an operative position adjacent the auxiliary handling unit 2.

In its operative position, the transfer unit 7 is positioned adjacent a tool holder 11 of the press 1. Such tool holder is movable from an external position to its illustrated location within the press by means of a rolling table 14 (FIG. 1). In the external position, a plurality of such tool holders may be disposed within and accessed from a suitable magazine 15.

The movement of the various elements **2, 4*a*, 4*b*, 7, 9 and 11 to and from their operating positions may be accomplished by means of suitable actuating means (not shown). The tool holder 11, which in its operative position is clamped by means of elements 29 (FIG. 1), is provided with tool-positioning means including transfer bars 12 having suitable grippers which may be clutch-coupled to the link drive system 61, as indicated below. The movement of the transfer bars 12 within the tool holder 11 is limited by means of blocking members 13. A driving connection between the gripping means of the transfer bars 12 and the transfer mechanism 7** positioned adjacent the tool holder is accomplished by suitable coupling means (not shown).

Figure 3:
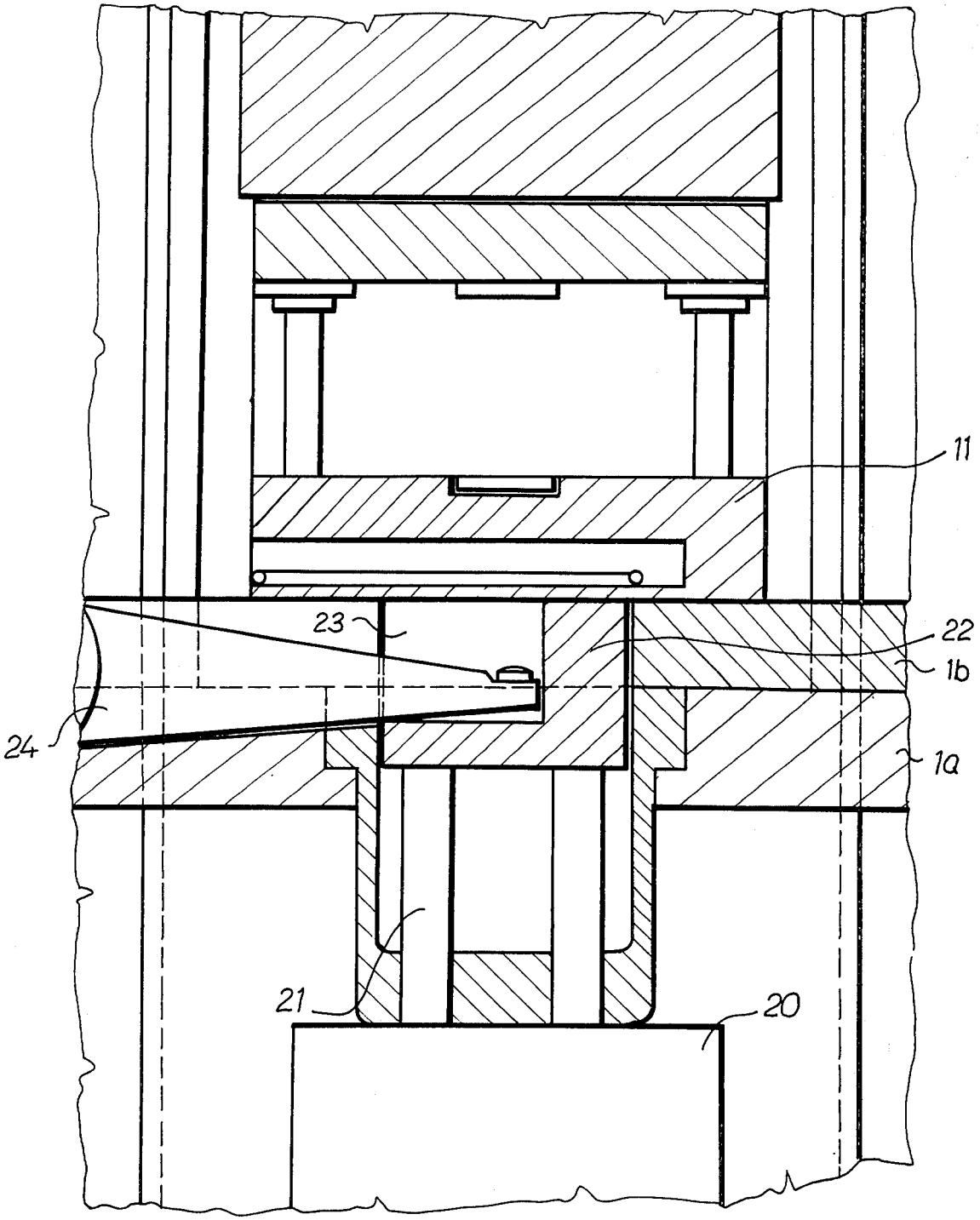
FIG. 3 is an enlarged fragmentary sectional view in elevation of a portion of the arrangement of FIG. 2.

As shown in FIG. 3, the press 1 includes a table 1a and an overlying bolster **1*b* having a central cavity for receiving a pressure plate 22, which is supported via pins 21 by a cushion 20 integral with the press. A suitable ejection lever 24 is supported within the cavity 23, such ejection lever being actuated by suitable means (not shown) coupled to the main drive of the press. In a conventional manner, the ejection lever 24** operates the ejection pin (not shown) which is disposed coaxially with the lower die (not shown) of the press.

Figure 4:
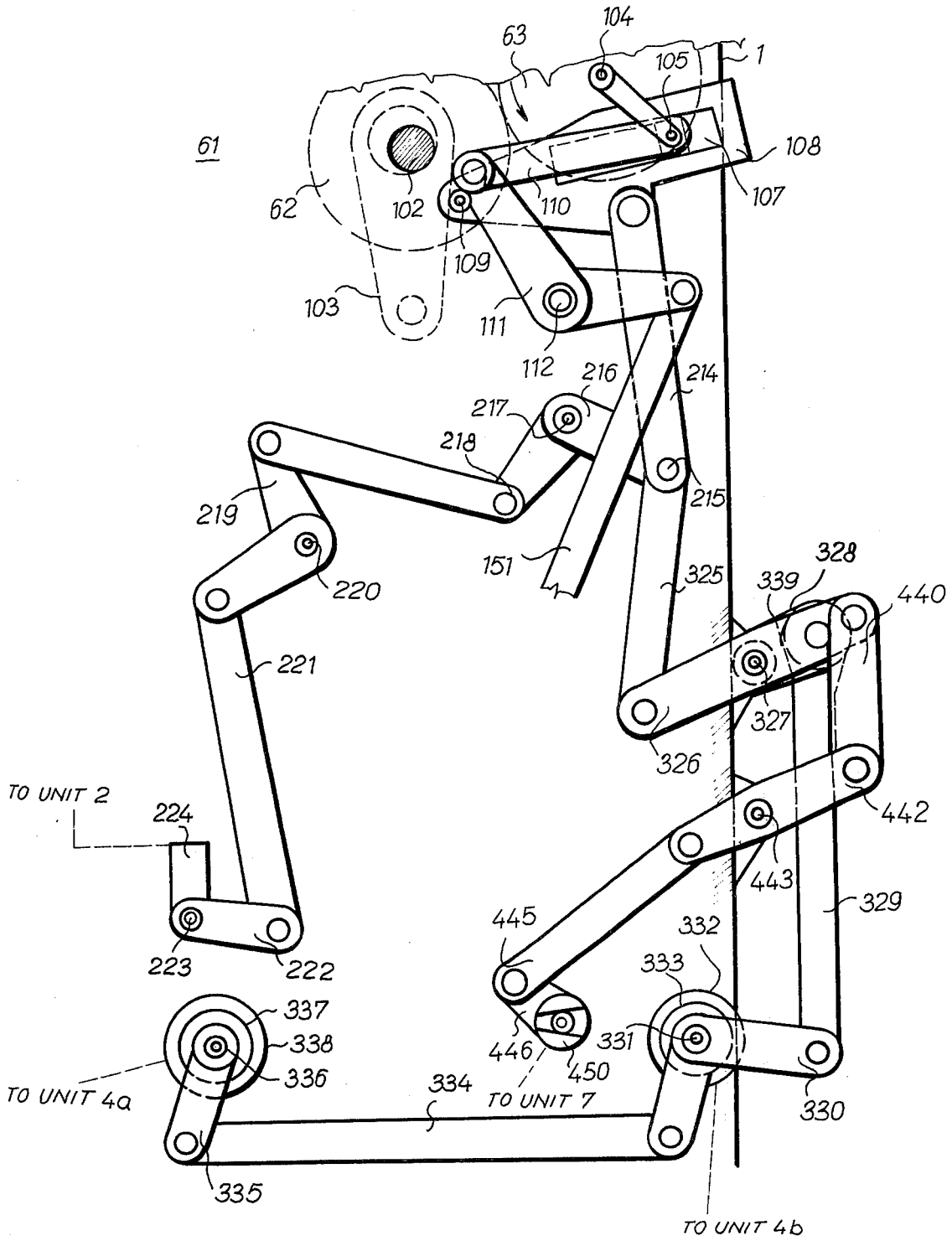
FIG. 4 is a schematic representation of a progressive link-type drive system selectively interconnecting the various auxiliary workpiece-handling elements of FIGS. 1–3 with a main drive shaft of a system press.

As shown best in FIG. 4, the operating systems for the individual auxiliary workpiece-handling elements **2, 4*a*, 4*b* and 7 operate off a main drive shaft 102, which is connected to a main connecting rod 103 of the press. The main shaft 102 is connected by 1:1 gears 62, 63 and an auxiliary shaft 104, with a crank having a main driving pin 105. A slide block 106 is mounted on pin 105 and is slidable in a slot 107 of a drive crank arm 108. The arm 108 is pivotally mounted on a rigid support pin 109** disposed on the press frame.

Disposed on the main driving pin 105 is a link 110 attached to a two-arm lever 111. The lever 111 is arranged in a radially adjustable pin 112 seated in the press frame. The two-arm lever 111 may be connected by an extended link 151 with a non-illustrated opening mechanism on the grippers of the workpiece-transfer unit of the press.

To drive the handling unit 2, the crank arm 108 is coupled to a main link 214 which actuates, via a double pin 215, a two-arm lever 216 mounted by an auxiliary support pin 217 in the press frame. The two-arm lever 216 is joined by a horizontal link 218 with an angle lever 219, which is mounted by a pin 220 in the press frame. The angle lever 219 is coupled by a vertical link 221 with both a swing arm 322, arranged on a shaft 223 in the press frame 1, and with an arm 224. The arm 224 is connected to the unit 2.

To drive the handling unit 4*b*, the double pin 215 is coupled by a link 325 both to a swing lever 326 and to a shaft 327 on which is mounted an adjustable lever 328. The lever 328 transmits, via link 329 and a lower two-arm lever 330, the resulting swinging motion to a shaft 331 on which is keyed an overrunning clutch 333. The element 333 transforms the above-mentioned swinging motion into a unidirectionally rotational stepwise motion which, through a face claw coupling 332, is transmitted to suitable exit feed rolls in the unit 4*b*.

A lower link 334 transmits the above-mentioned swinging motion through lower lever 335 to an input shaft 336, on which is keyed an overrunning clutch 337 which transforms the swinging motion into a unidirectionally rotational stepwise motion. A claw coupling 338 mounted on the overrunning clutch 337 rotates a suitable corresponding claw clutch in the handling unit 4*a*.

To operate the transfer drive unit 7, the swinging lever 216 is coupled to a toothed clutch 450 via a system of levers and links 440, 442, 445, 446 swingable on a pin 443, the member 440 being elastic. The swinging motion of the lever 446 is converted to a unidirectionally rotational stepwise motion by means of the clutch 450, which in turn is in engagement with a corresponding clutch of the unit 7.

It will be understood that the working cycle of the overall system is basically the same as with standard press-type systems of this type, and the auxiliary handling units work in a conventional manner. When the operations on each workpiece are finished, a program device initiates a sequence of operations for the preparation of the system for a different type of work.

In the foregoing, the invention has been described in connection with an illustrative arrangement thereof. Many variations and modifications will now occur to those skilled in the art. It is accordingly desired that the scope of the appended claims not be limited to the specific disclosure herein contained.

I claim:

1. In a metal-forming system, a central press having a main drive shaft for performing operations on workpieces, first, second and third auxiliary handling means for selective types of feeding for introducing workpieces to, discharging workpieces from, and transferring workpieces within the central press, means pivotally connecting the first, second and third handling means to the press for movement toward and away from operative positions adjacent the press, and means coupled to the main drive shaft for individually operating the first, second and third handling means.

2. A system as defined in claim 1, in which the press includes first, second and third shafts vertically mounted therein, and in which the pivotal connecting means comprises means for individually coupling the first, second and third handling means to said shafts for movement in a horizontal plane.

3. A system as defined in claim 1, in which the system further comprises a workpiece magazine pivotally connected to the press for movement in a vertical plane into a position adjacent one of the first, second and third handling means.

4. A system as defined in claim 1, in which the press comprises, in combination, a table, a cushion disposed in the table, tool holder support means mounted above and in spaced relation to the cushion and having a central cavity, and an ejection lever supported within the cavity.

5. A system as defined in claim 1, in which the individually operating means comprises a plurality of clutch means individually associated with the first, second and third handling means for engaging said handling means for operation.

6. A system as defined in claim 5, in which the individually operating means comprises, in combination, first link means coupled to the main drive shaft and engageable with the first handling means, and second link means coupled to the first link means and engageable with the second handling means.

7. A system as defined in claim 6, in which the individually operating means further comprises third link means coupled to the second link means for engaging the third handling means.

8. A system as defined in claim 7, in which the system comprises a plurality of tool holders exchangeably movable from an external position into an operating position in the press, and means for guiding a selected one of said tool holders between the external and operating positions.

* * * * *